United States Patent [19]

Shroyer

[11] 4,188,602

[45] Feb. 12, 1980

[54] RELAY REPAIR APPARATUS

[76] Inventor: Cecil E. Shroyer, Rte. #3, Coshocton, Ohio 43812

[21] Appl. No.: 870,938

[22] Filed: Jan. 20, 1978

[51] Int. Cl.[2] ..... H01H 45/04

[52] U.S. Cl. ..... 335/132; 335/136

[58] Field of Search ..... 335/132, 202, 136; 361/96

[56] References Cited

U.S. PATENT DOCUMENTS

| | | | |
|---|---|---|---|
| 3,325,690 | 6/1967 | Kruzic et al. | 335/132 |
| 3,836,879 | 9/1974 | Frye | 335/136 |
| 3,882,435 | 5/1975 | Grass et al. | 335/132 |

*Primary Examiner*—Harold Broome
*Attorney, Agent, or Firm*—Millard, Cox & Smith

[57] ABSTRACT

Apparatus for Quick Repair of Faulty Electrical Relays. The apparatus for Quick Repair comprises an auxiliary assembly having means for securing it resiliently and quickly to a defective relay and having (1) an electrical coil; (2) a member movable by electrically created force in the coil to bear upon an operative movable member of the defective relay; and (3) electrical connections from the electrical coil to be connected to the means for normally supplying electrical current to the relay.

10 Claims, 9 Drawing Figures

RELAY REPAIR APPARATUS

BACKGROUND OF THE INVENTION

The invention disclosed herein relates to electrical relays. It especially relates to the many thousands of electrical relays used in industry to control in orderly sequence the machines used in all kinds of manufacturing operations, but it also relates to all relays used in materials processing, material handling, elevator control, metalworking, business machines and electronic equipment, etc. Such relays, being used often in great quantities even in one manufacturing operation, are prone to failure and to cause shutdowns of such operations because if even one of such relays breaks down often the whole operation must stop. The part of the relay which fails most often is the coil. In such cases it is usually necessary to shut down the whole operation until the defective relay can be repaired. In such repair it is usually necessary to disconnect many electrical leads from the relay and either substitute a new relay or repair the old one. In the meantime all operations must stop. The relays in use usually include a solenoid having an electrical coil and a core and a plurality of switches. The core itself may be a movable member operative (when the coil is energized by electrical energy or is de-energized) to open some switches and close others to continue the manufacturing operation. Or there may be a separate movable member similarly operative upon the energizing or de-energizing of the electrical coil.

With the many, many thousands of relays in use in manufacturing operations (mechanical, electrical and chemical) and the great amount of time lost by shutdowns, the saving in energy by the use of my Quick Repair Apparatus is tremendous.

2. Prior Art

Many prior art patents relate to relays and to their use in controlling electrical circuits in manufacturing operations. A search disclosed the following U.S. Patents which bear some relation to the subject matter disclosed herein.

Scheib, Jr. U.S. Pat. No. 3,099,728;
Bundy et al U.S. Pat. No. 3,178,534;
Gubble et al U.S. Pat. No. 3,235,686;
Scheib, Jr. U.S. Pat. No. 3,299,378;
Marren U.S. Pat. No. 3,501,723;
Fiyita U.S. Pat. No. 3,548,349;
Puetz et al U.S. Pat. No. 3,643,190;
McGary U.S. Pat. No. 3,824,589.

We were unable in our search to find a specific disclosure of a special device providing a coil which snaps on over a defective coil thereby very quickly and effectively replacing it temporarily until it can be further repaired.

OBJECTS

It is an object of the invention to provide a Quick Snap Coil Assembly capable of quickly and effectively repairing a defective relay without removal of the electrical leads secured to the relay, however many there may be.

A further object of the invention is to provide a Quick Snap Coil assembly consisting essentially of (1) an electrical coil, (2) a movable member controlled by the supply of electrical energy to the coil and by the withdrawal of electrical energy therefrom and arranged to operate a corresponding movable member of a defective relay, and (3) electrical leads for connecting the coil electrically to a means for normally supplying electrical energy to the defective relay in combination with means for quickly securing the Quick Snap Coil Assembly resiliently to the defective relay.

It is a further object of the invention to provide an auxiliary assembly for use with an electrical relay comprising (1) an electrical coil, (2) an operative member therefor movable relative to said coil when electrical energy is supplied thereto and when electrical energy is withdrawn from said coil, (3) means comprising an electrical switch for controlling electrical energy in a separate circuit, the switch being operable upon movement of said operative member, and (4) means for supplying electrical energy to said coil, said auxiliary assembly having (1) means by which it may be secured quickly to said relay, having (2) an auxiliary solenoid consisting of an auxiliary electrical coil, (3) means comprising an operative member movable relative to said auxiliary electrical coil to bear upon the operative member of the electrical relay and thus to operate the electrical relay operative member and switch even though the relay coil should fail to operate, and having (4) electrical leads for connecting the auxiliary coil to the means for supplying electrical energy to said relay coil.

It is also a further object of the invention to provide an auxiliary assembly (Quick Snap Coil Assembly) that can be installed quickly and easily on a relay that is suspected of intermittent failure wherein even if the suspected relay is okay, the extra installed assembly creates no problem at all.

It is also an object of the invention, that an auxiliary assembly can be installed safely without turning off any electrical power since it is equipped with insulated clips on the coil leads.

It is also the object of the invention to be able to install an auxiliary assembly designed to operate on one voltage and use it on a relay designed to operate on a different voltage. For example, an operator can install the Quick Snap Coil Assembly designed for 115 volts A.C. on a #CR120K42048AA Relay designed to operate on 24 volts D.C. and use the combination in place of a CR120K42002AA 115 volt 60 H.Z. Relay, if the operator happened to be out of the CR120K42002AA Relay. Also the operator could attach a Quick Snap Coil Assembly rated at 24 volt D.C. to a CR120K42002AA Relay rated at 115 volt 60 H.Z. The operator could use this combination in place of a #CR120K42048AA 24 volt D.C. Relay if he were out of them. Thus it is possible to match these relays of different voltages with Quick Snap Coil Assemblies of different voltages. You can use a relay in a great many diverse situations.

Further objects and features of the invention will be apparent from the following description and claims and the accompanying drawings.

SUMMARY OF THE INVENTION

The invention comprises a Quick Snap Coil Assembly for the quick repair of relays which have a defective coil. It enables substantially any capable workman (whether a skilled electrician or not) to repair quickly and effectively a defective relay wherein the coil has burned out or is otherwise inoperative. To do this the workman merely removes the upper spring protective cap from the relay and snaps in place an operative coil having a spring clamp substantially identical with the protection cap which has been removed. Assuming that the electric current has been turned off, he connects electrical leads which are connected to the ends of the coil to the connections on the relay and lead to a source of electrical energy. Then the current is turned on and the repair is made in seconds where under conventional practice, many minutes or perhaps some hours may be required. Preferably however and if desired the repair may be made with care by an electrically skilled workman without turning off the electric current. The Quick Snap Coil Assembly consists merely of a casing and an electrical coil and a movable member which may be the core of the coil or which preferably as shown herein may be separate. The movable member extends downward from the casing of the Quick Snap Coil Assembly and into the casing of the defective relay and is arranged to operate the corresponding movable member of the defective coil of the relay.

BRIEF DESCRIPTION OF DRAWINGS

In the drawings:

FIG. 8 is a view identical with FIG. 7 but showing positions of some of the switches with the control current on.

DETAILED DESCRIPTION OF THE PREFERRED EMBODIMENT

Figure 1:
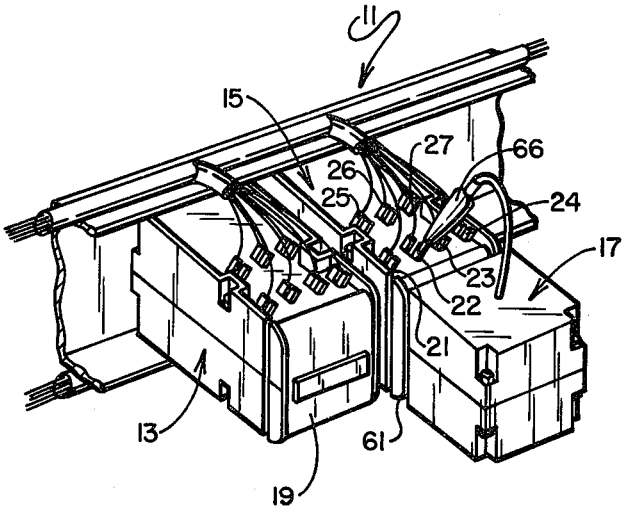
FIG. 1 is a view in perspective of a pair of relays both mounted in a holder and one provided with a Quick Snap Coil Assembly in accordance with an embodiment of my invention.
Figure 3:
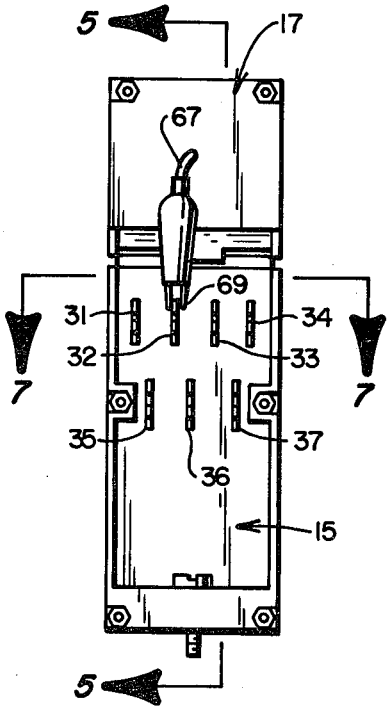
FIG. 3 is a view in side elevation of a relay equipped with a Quick Snap Coil Assembly substantially identical with the comination shown in FIGS. 1 and 2 but showing the side opposite to that shown in FIG. 1.

Referring to the drawings for a more detailed description and first as an introduction referring especially to FIG. 1, there may be seen a holder 11 in which are positioned relays 13 and 15. On the assumption that relay 15 is defective, there has been attached thereto a Quick Snap Coil Assembly 17. Relay 13 is assumed to be fully operative. Each of the relays normally has a protective cap or dust cover such as the cap 19 shown on the relay 13 in FIG. 1 but the protective cap for defective relay 15 has been removed as will be explained later. Each of the relays has 14 leads attached thereto and 14 connectors for these leads are provided. Seven of these connectors are shown in FIG. 1 and are designated 21, 22, 23, 24, 25, 26 and 27 and the other seven are shown in FIG. 3 and are designated 31, 32, 33, 34, 35, 36 and 37.

Figure 4:
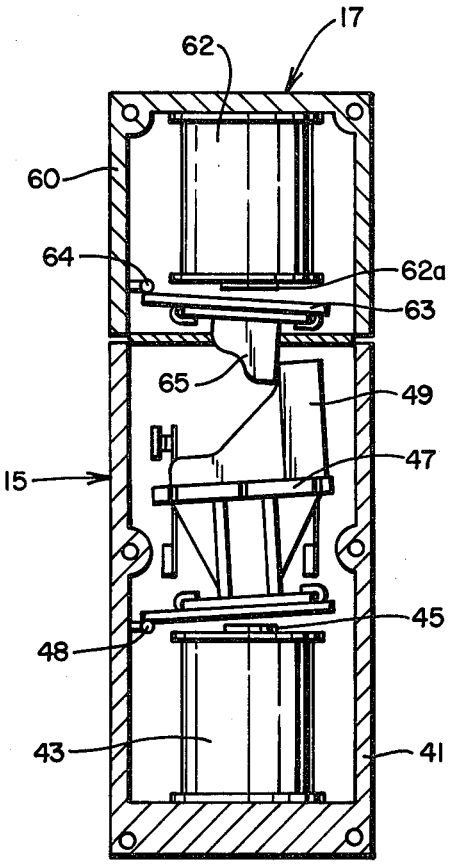
FIG. 4 is a view in vertical section taken substantially along the line 4—4 of FIG. 2.

Within the casing 41 of the relay 15 (as shown in FIG. 4), and showing the usual operating parts of the relay 15, there is an electrical coil 43 having a core 45, a movable member or operating arm 47 pivoted at 48. On arm 47 there is formed a projection 49 sometimes designated a manual operator tab formed there so that normally the relay may be operated manually in an emergency. Usually the coil 43 is operated by 115 volt A.C. but some relays are provided with coils having different operating voltages as for example, 24 volt D.C. My Quick Snap Coil Assembly 17 is operative regardless of the voltage which operates the relay coil 43 at least in the ranges of from 6–250 volts, A.C. or D.C. for example. However preferably individual Quick Snap Coil Assemblies will be kept on hand for the voltages of each type of relay used in the factory or other installation.

Figure 7:
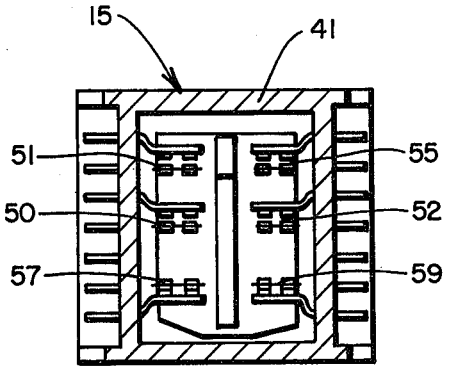
FIG. 7 is a plan view of the relay with the protective dust cover cap removed showing the position of some of the switches with the control current off.
Figure 8:
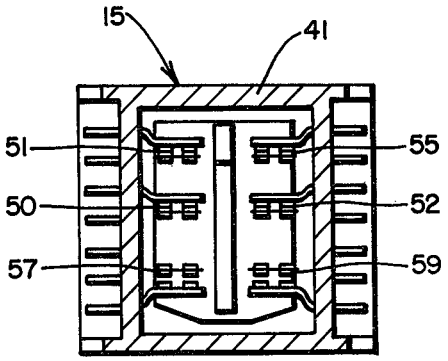
Figure 9:
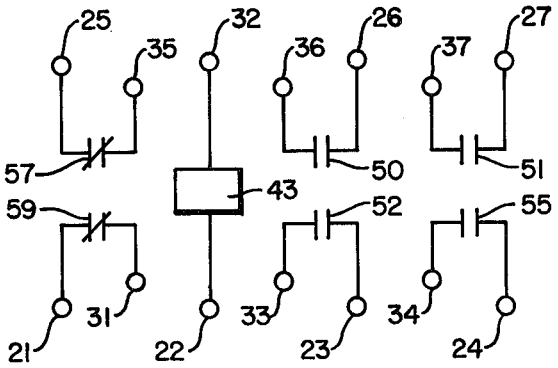
FIG. 9 is an electrical diagram illustrating the electrical circuits of a typical relay for controlling electrical circuits of a manufacturing operation.

Normally open switches 50, 51, 52 and 55 and normally closed switches 57 and 59 (see FIGS. 7 and 9) are positioned in the casing 41 so that they may be changed from the open position to the closed position or vice versa (see FIG. 8) by movement of the operating arm 47.

Figure 2:
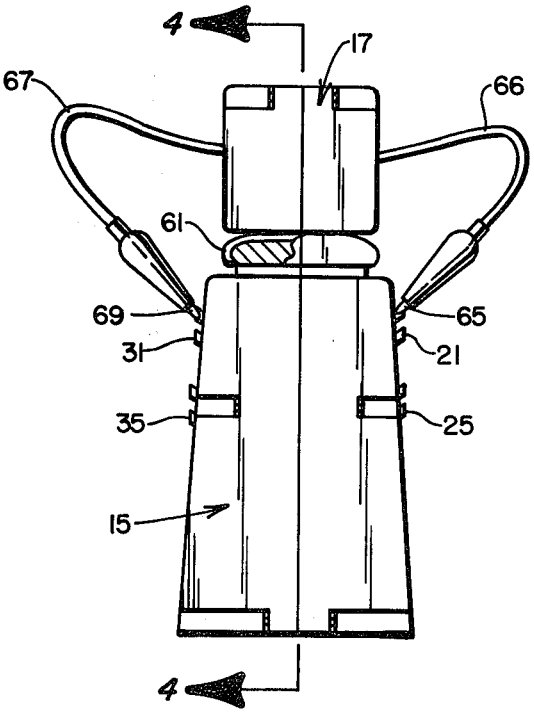
FIG. 2 is a view in front elevation of a relay equipped with a Quick Snap Coil Assembly in accordance with an embodiment of my invention.
Figure 5:
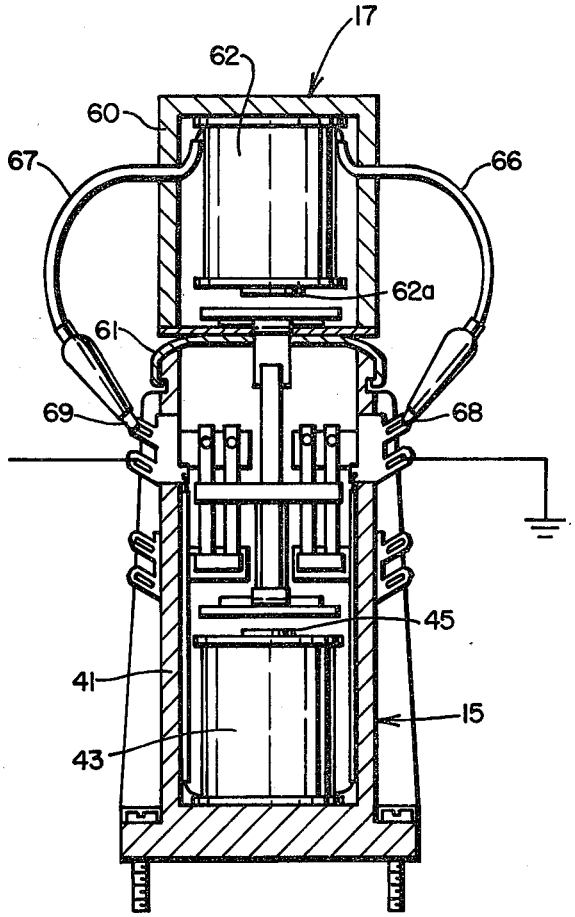
FIG. 5 is a partly diagrammatic view in vertical section taken along the line 5—5 of FIG. 3.
Figure 6:
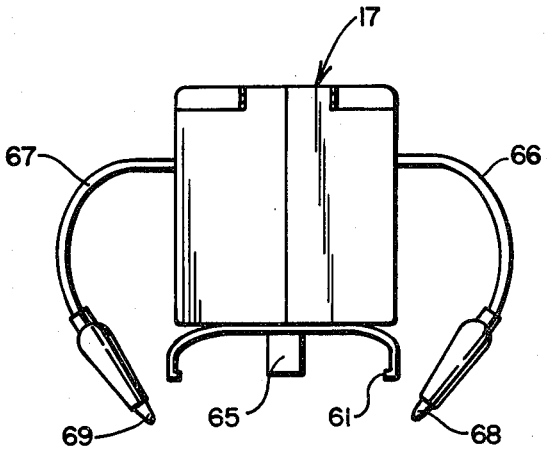
FIG. 6 is a view in side elevation of the auxiliary Quick Snap Coil Assembly.

Quick Snap Coil Assembly 17 comprises a casing 60 having a spring connector 61, a coil 62, an operating arm or movable member 63 pivoted at 64. The coil 62 has a core **62*a*. The movable member 63 has an extension or cam 65 which contacts with a projection 49 on the operating arm or movable member 47 of relay 15. When the coil 62 is actuated by the supply of electrical energy to or withdrawal of electrical current from coil 62, the movable member 63 moves and thus moves the relay operating arm 47 to open or close the switches. Connected to the coil 62 are a pair of electrical leads 66 and 67 (see FIGS. 2 and 5). These leads extend through the casing 60 (see FIG. 6) and have spring clips 68 and 69** at their outer ends respectively.

OPERATION

Normally both relays 13 and 15 operate without difficulty to control the circuits served by connectors such as 21-31, 23-33, 24-34, 25-35, 26-36 and 27-37. Connectors 22 and 32 are connected to a source of electrical energy which is supplied or withdrawn in sequence by an electrical operating current as programed for the manufacturing operation. However should one of the relays (such as 15 for example) fail to operate for any reason (such failure is normally on account of a faulty coil), the protective cap or dust cover (as for example cap 19) is removed (snapped off) and the Quick Snap Coil Assembly is snapped on and secured by spring connector 61. Thereupon whenever electrical energy flows through the lead connected to connector 22, it flows through lead 66, coil 62, lead 67, connector 32 and back to ground. This energizes coil 62 which through core **62*a* attracts the movable member 63. Movable member 63 operates member 47 mechanically to close switches 50, 51, 53 and 55 and to open switches 57 and 59. This energizes circuits including the connectors 21-31, 23-33, 24-34, and 25-35 and the leads connected thereto and breaks circuits which include the connectors 26-36 and 27-37** and the lead connected thereto.

The Quick Snap Front Cover allows any qualified person to snap the Quick Snap Assembly on in a matter of seconds, and makes the relay completely operable instantly. The Quick Snap Coil Assembly can be installed and hooked up in a matter of seconds, without entirely shutting down, or turning off any electrical power. This can be done as described above without any possible danger to a qualified person in a matter of seconds. This can be installed on a relay that is suspected of periodic malfunction, or on a perfectly working relay without any danger or problems resulting.

Quick Snap Assemblies with different coils to match different voltage relays such as 115 volt to 24 volt A.C. or D.c. may be kept on hand and used on various relays as needed. This definitely means No Shut Down for burned out or malfunctioning relays. When a Quick Snap Assembly is working and it fails it can be replaced by another Quick Snap Assembly in seconds without shutting the operation down or killing all electrical power.

When the Quick Snap Coil Assembly 17 is installed on a relay, the coil operated arm 63 of the Quick Snap Coil Assembly will make contact with the coil operated arm 47 of the faulty relay. The Quick Snap Coil Assembly 17 will move its own operating arm 63 back and forth. Since it makes contact with the operating arm 47 of the faulty relay, it will move the operating arm 47 of the faulty relay back and forth, thus doing the same job exactly as the original coil was doing. By using the Quick Snap Coil Assembly to move the operating arm of the faulty relay back and forth, the operator is opening and closing contact points in the faulty relay with the same electrical circuit that was originally used to do it. Even though the original coil in the faulty relay is inoperative, the Quick Snap Coil Assembly will move the faulty coil's operating arm back and forth operating it properly, closing and opening contacts in the faulty relay at the proper time, and using the same electrical circuit as the original to do it, since the Quick Snap Coil Assembly leads are connected to the coil terminals of the faulty relay.

The Quick Snap Coil Assembly provides an easy method to accomplish the following:

(a) The ability to change the electrical control circuit of a machine, or operation without changing the relays. This is best accomplished by snapping a Quick Snap Coil Assembly of the desired type and voltage of electricity as was used on the original relay or relays and then connecting the electrical control circuit wires to the wires of the Quick Snap Coil Assembly instead of the coil terminals on the original relay, or alternatively as shown in the embodiment illustrated connecting the wires 66 and 67 of the Quick Snap Coil Assembly 17 to the connectors 22 and 32 to which the electrical coil circuit wires are connected.

(b) The ability to use an electrical relay from stock rated 120 volts A.C. 60 Hz on a 24 volt D.C. circuit where no 24 volt D.C. relay is available by the use of a Quick Snap Coil Assembly rated 24 volts D.C.

(c) The Quick Snap Coil Assembly provides all the above mentioned benefits, plus the main benefit of being able to install it on a faulty relay due to a malfunctioning coil without shutting the machine or operation down or shutting off any electrical power or any special tools in less than 1 minute as earlier described.

It is to be understood that the above described embodiment of my invention is for the purpose of illustration only and various changes may be made therein without departing from the spirit and scope of the claims which follow.

I claim:

1. For use with an electrical relay of a variety including a housing, an electrical coil mounted within said housing and energizable from a source connectable with electrical contacts positioned upon said housing, a movable member within said housing for selectively carrying out switching logic, having a first biased switching position and movable to a second switching position upon the energization of said coil, said movable member including a projecting portion movable therewith and said housing having an opening over which may be mounted a cap, said cap, when so mounted, being situated at a location adjacent said movable member projecting portion, the improved auxiliary assembly comprising:

a casing mountable over said opening;

an auxiliary electrical coil mounted within said casing;

means for connecting said auxiliary electrical coil with said source when said casing is mounted over said opening; and an operative member mounted within said casing, extensible to said movable member where said casing is mounted over said opening and having a first position exhibiting no operational influence over said movable member such that said movable member is in said first biased switching position when said auxiliary coil is unenergized, said operative member being movable into a second position in contact against said movable member projecting portion when said auxiliary coil is energized from said source to cause said movable member to move to said second switching position.

2. The improved auxiliary assembly of claim 1 wherein said operative member is extensible into a said first position in contact against said movable member projecting portion when said auxiliary coil is unenergized such that said movable member remains in said first biased switching position.

3. The improved auxiliary assembly of claim 1 including spring connector means fixed to said casing and extensible over said relay housing for securing said casing to said housing.

4. The improvement of claim 3 in which:

said electrical relay further comprises a snap-on type said cap removably mounted over said opening; and said spring connector means is configured in substantial correspondence with said cap for effecting a resiliently biased retention of said casing over said opening.

5. The improved auxiliary assembly of claim 1 in which said operative member is extensible into a said first position which is in slideable contact with said movable member projecting portion when said casing is mounted over said opening and said auxiliary coil is unenergized, said operative member being movable in driving slideable relationship against said projecting portion when said auxiliary coil is energized from said source.

6. The improved auxiliary assembly of claim 5 in which said first position slideable contact of said operative member effects no switching influence over said movable member when said auxiliary coil is unenergized.

7. The improved auxiliary assembly of claim 1 in which said means for connecting said auxiliary electrical coil with said source comprises two electrical leads coupled with said auxiliary coil and having manually operable connectors fixed thereto for connection with said electrical contacts.

8. The improved auxiliary assembly of claim 1 in which the operative member is a core movable within the auxiliary coil.

9. The improved auxiliary assembly of claim 8 in which the relay movable member is a core movable within the relay coil.

10. The improved auxiliary assembly of claim 8 in which the relay movable member is a pivoted member which is attracted to the core by magnetic force when the coil is energized by electric energy which passes through the coil.

* * * * *